United States Patent [19]

Beretta

[11] Patent Number: 4,984,504

[45] Date of Patent: Jan. 15, 1991

[54] DEVICE TO OPEN AND CLOSE THE BOLT IN SEMIAUTOMATIC PISTOLS

[75] Inventor: Pier G. Beretta, Gardone V.T., Italy

[73] Assignee: Fabbrica D'Armi P. Beretta S.p.A., Gardone V.T., Italy

[21] Appl. No.: 403,568

[22] Filed: Sep. 6, 1989

[51] Int. Cl.[5] ..... F41A 5/06

[52] U.S. Cl. ..... 89/163

[58] Field of Search ..... 89/163

[56] References Cited

U.S. PATENT DOCUMENTS 580,925 4/1897 Browning ..... 89/163

1,067,054 7/1913 Nardin ..... 89/163

FOREIGN PATENT DOCUMENTS 335455 2/1936 Italy ..... 89/163

*Primary Examiner*—Stephen C. Bentley

*Attorney, Agent, or Firm*—McGlew & Tuttle

[57] ABSTRACT

The invention relates to a device opening and closing the bolt of semiautomatic pistols with a barrel which is rotating and axially displaceable in the stock and interacting with the bolt in such a way that during the first section of the back motion barrel and bolt are integral and without a relative motion, while in the second section the barrel rotates in respect to the bolt but is still following its linear movement till the barrel stops and the bolt moves back for the actual opening of the arm.

4 Claims, 5 Drawing Sheets

DEVICE TO OPEN AND CLOSE THE BOLT IN SEMIAUTOMATIC PISTOLS

FIELD AND BACKGROUND OF THE INVENTION

The inventions relates, in a general way, to semiautomatic pistols and more in particular to a device designed to open and close the bolt of said pistols.

Some pistols of known design are already fitted with a barrel apt to rotate in the stock of the arm and interacting with the bolt slide to control its opening motions when ammunition has been fired. The rotation of the barrel is obtained by its screws connection to a stationary item. However, according to the known execution, the only means keeping the bolt in its closed position is the screwed connection of the barrel and in addition during its back motion the bolt has to rotate the barrel by overcoming its resistance in order to reach its open position. Finally, the known opening system is rather bulky and therefore bent to increase the overall dimensions of the pistol.

SUMMARY AND OBJECT OF THE INVENTION

It is instead the purpose of the present invention to propose a pistol with a rotating barrel as mentioned above but with an improved connection between barrel and bolt to allow:

- a general reduction of the overall dimensions of the arm in comparison to the known executions by reducing the dimensions of the opening and rotating device;
- a positive lock of the bolt on the barrel in its closed position and during part of its opening motion, both manually and by recoil;
- a substantial delay in the opening of the bolt in order to fully exploit the gases in the barrel for the ejection of a shot each time ammunition is fired, by preventing at the same time the gas from hitting the shot the moment the bolt is opened.

To this purpose the device proposed by the present invention to be fitted on pistols with a barrel rotating in the stock of the arm and interacting with the bolt by means fo a screwed connection, the bolt being normally displaced by a spring to its closed position, is characterized in that the barrel is also axially displaceable in the stock and presents a groove with an initial portion which is rectilinear and parallel to the axis of the barrel followed by a helicoidal portion on one side, while on the other side at least one shoulder is forward projecting, in that in the stock of the arm a block is fixed with a tooth engaged in said groove to produce the rotation of the barrel in consequence of its axial displacement, and two axially spaced abutments which are designed to define the axial displacements of the barrel, and in that the bolt has a rearward directed stop plane to engage said shoulder on the barrel when the bolt is closed, during one part of its opening stroke and when the barrel is rotated so that the rectilinear part of its slot is in front of the tooth of the fixed block, the bolt also presenting a rectilinear and longitudinal groove extending from said stop plane in a forward direction and receiving said shoulder on the barrel when the latter is turned by the tooth interacting with the helicoidal slot and the bolt is axially displaced to its open position.

The characteristics of the invention will be more apparent from the detailed description given hereinafter with reference to the enclosed drawing in which:

FIG. 1 shows a perspective view of the bolt and the barrel and, separately, the fixed block interacting with the barrel;

FIG. 1*a* shows a cutaway view of the bolt with the barrel fixed to the bolt itself;

FIG. 2 shows a longitudinal section of a pistol with its bolt locked in a closed position;

FIG. 2*a* shows a cross section on the line II—II in FIG. 2;

FIG. 2*b* shows a view of the barrel and the tooth interacting with the relating groove when the pistol is in the condition shown in FIG. 2;

FIG. 3 shows a longitudinal section according to FIG. 2, but with locked bolt and barrel in rearward position;

FIG. 3*a* shows a cross section on the line III—III in FIG. 3;

FIG. 3*b* shows a view of the barrel and the tooth interacting with the relating groove when the pistols is in the condition shown in FIG. 3;

FIG. 4 shows another longitudinal section of the pistol, but with rotating barrel moving to the rear with the bolt;

FIG. 4*a* shows a cross section on the line IV—IV FIG. 4;

FIG. 4*b* shows a view of the barrel and the tooth interacting with the relating groove when the pistol is in the condition shown in FIG. 4;

FIG. 5 shows still a longitudinal section of the pistol, but with stationary barrel and fully opened bolt;

FIG. 5*a* shows a cross section on the line V—V in FIG. 5;

FIG. 5*b* shows a view of the barrel and the tooth interacting with the relating groove when the pistol is in the condition shown in FIG. 5;

DETAILED DESCRIPTION OF THE PREFERRED EMBODIMENT

Figure 1:
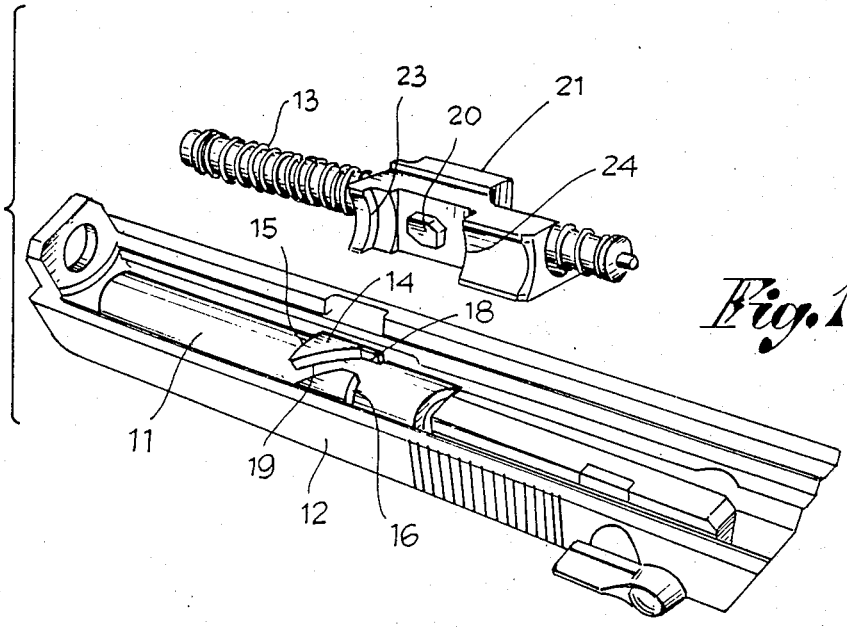
Figure 1A:
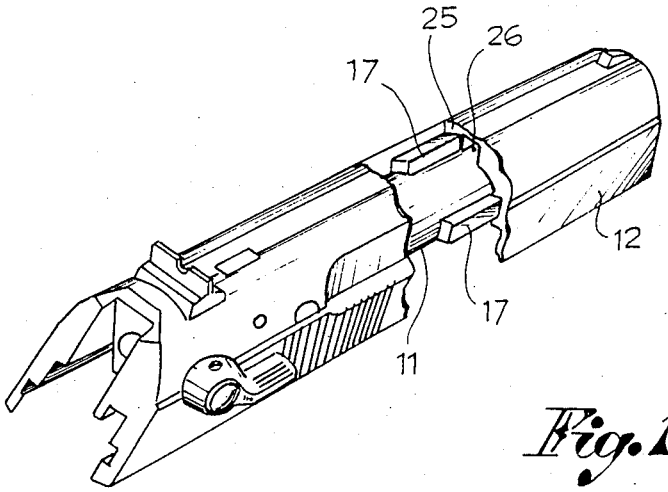

In a known manner, on the stock of a pistol a barrel (11) is mounted and covered by an interacting bolt (12). The barrel (11) is provided such that it can rotate in respect to the bolt and to the stock and it is also displaceable in an axial direction. The bolt (12) is able to axially move on the stock both with the barrel and independently to pass from a front closing position on the barrel and an open rear position far from the barrel. The bolt is subject to a spring (13) normally keeping it in its front closed position, its back motion being obtained either manually or automatically by recoil forces due to the firing of a shot.

Now, according to the invention and to its embodiment shown on the drawing, barrel (11) is fitted in an intermediate position, with an overlapping section (14) with spaced front and back stops (15, 16) on one side, and on the other side with at least one forward directed shoulder (17) preferably collimating with the front shop (15).

In the overlapping section (14) (see FIG. 1) a slot is cut in which, starting from the back stop (16) has a first portion (18) which is rectilinear and parallel to the axis of the barrel and followed by a helicoidal portion (19) extending to the front stop (15).

A tooth (20) which is part of a fixed block (21) mounted on stock (10) and locked, for instance, by a tooth (20) or the like is engaged and interacts in said slot (18, 19), a spring (13) of bolt (12) longitudinally and freely passing through said block (21). Block (21) also presents on the opposite sides of tooth (20) two axially spaced abutments (23, 24) cooperating with stop ends (15, 16) on barrel (11) to limit it axial displacements.

The coupling between slot (18, 19) and tooth (20) is such that only an axial displacement of the barrel is possible when tooth (20) is interacting with the rectilinear portion (18) of the slot, while the barrel can move and simultaneouly rotate as a screw if the tooth is interacting with the helical portion (19) while the barrel is axially displaced in respect to block (21) and bearing tooth (20).

It is pointed out that the sense of rotation of the barrel allowing the opening of the bolt will be opposite to that to which the barrel is subject when a shot is fired and to that due to internal rifling.

In bolt (12) a stop plane (25) is facing rearwards and designed to interact with shoulder (17) of the barrel when the bolt is closed and the barrel has moved to the front to let tooth (20) engage the rectilinear portion (18) of the slot. Finally the bolt presents, starting from said stop plane (25), a longitudinal and rectilinear groove (26) extending towards its front to receive shoulder (17) and thus eliminate its stopping action as soon as the barrel has moved back and been rotated by tooth (20) interacting with the helicoidal section (19) of the slot.

Figure 2:
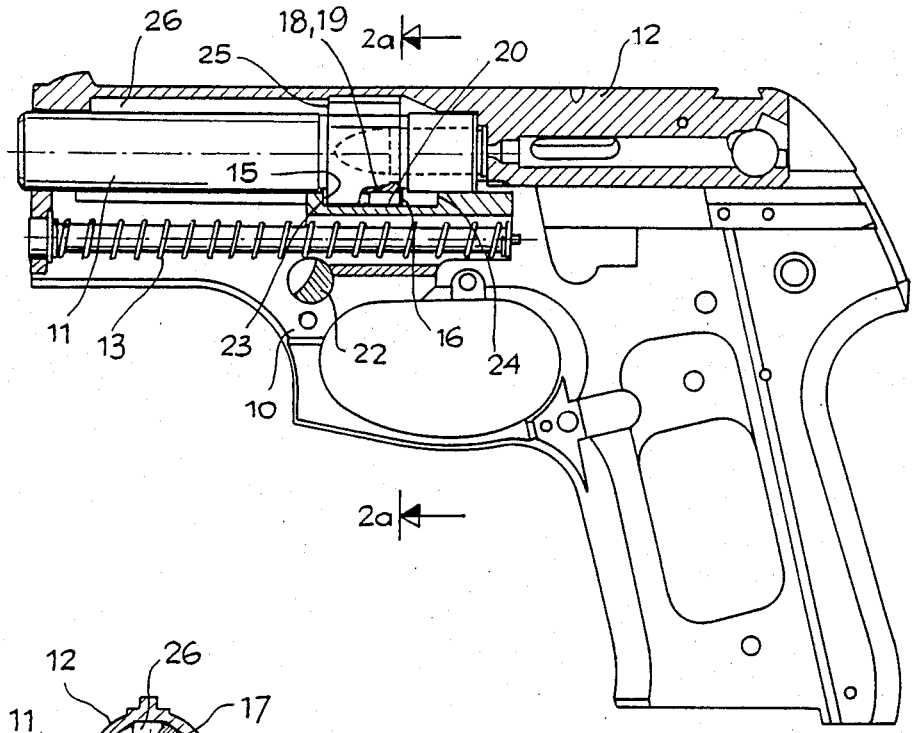
Figure 2A:
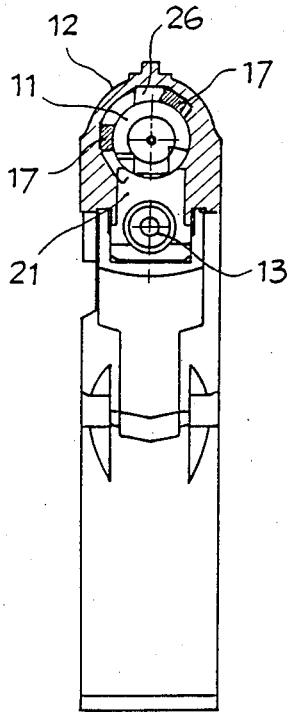
Figure 2B:
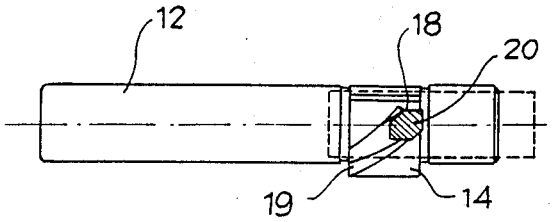

FIGS. 2, 2*a* and 2*b* of the drawing show the pistol with the bolt (12) moved towards the front and thus in closed position, where it is coupled with the barrel by means of the spring (13). In this position:

barrel (11) is displaced towards the front end, with its stop (15) bearing on the abutment (23) of the fixed block (21);

barrel (11) is rotated to have the rectilinear portion (18) of its slot engaged by tooth (20);

in consequence, shoulder (17) of the barrel is turned away from slot (26) in the bolt and positively bearing upon stop plane (25) of the bolt;

thus barrel and bolt make up a solid assembly in axial direction to prevent them from moving to and for each other and ensure the closure of the arm for its use.

Figure 3:
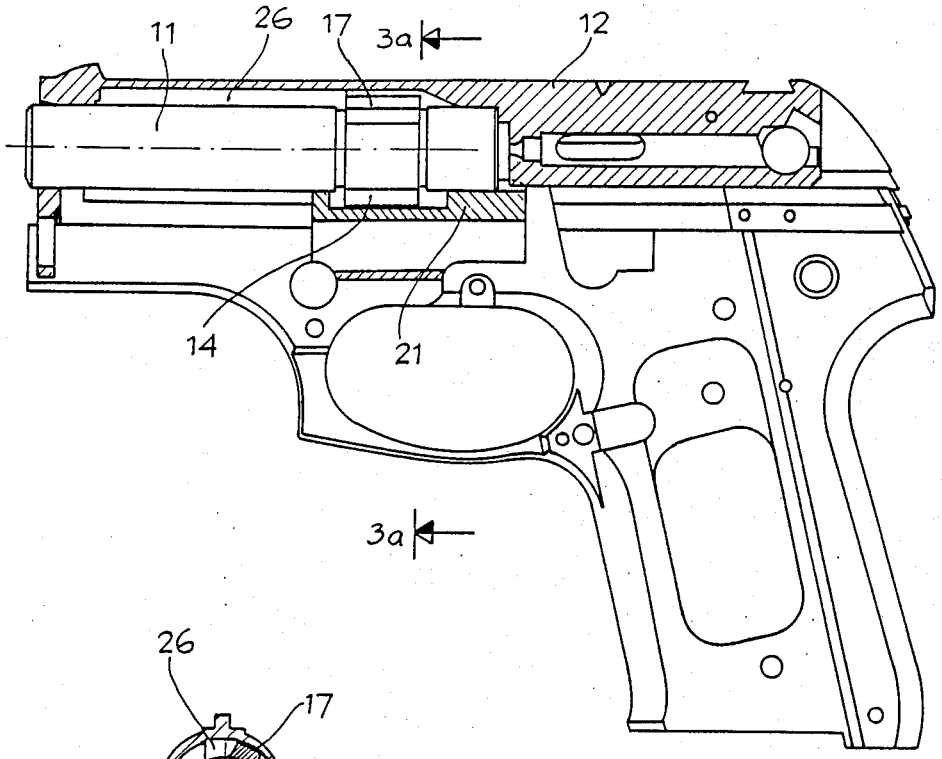
Figure 3A:
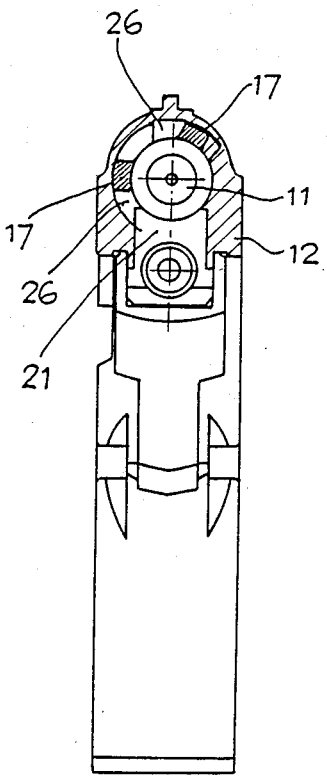
Figure 3B:
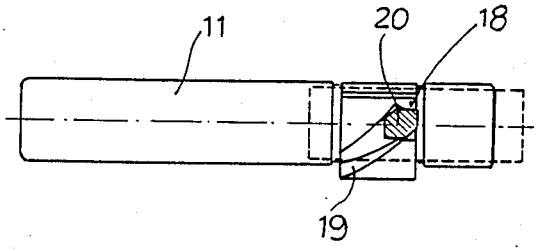

Starting from this closed position, after a shot has been fired out of the barrel and owing to the recoil forces the bolt is opened in opposition to spring (13) and through the following sequence:

through a first part of the recoil corresponding to the rectilinear slot (18) barrel and bolt are displaced together without any relative motion, the bolt taking back the barrel owing to the interaction between stop plane (25) of bolt (12) and shoulder (17) on barrel (11). This intermediate condition is shown on FIGS. 3, 3*a* and 3*b*.

Figure 4:
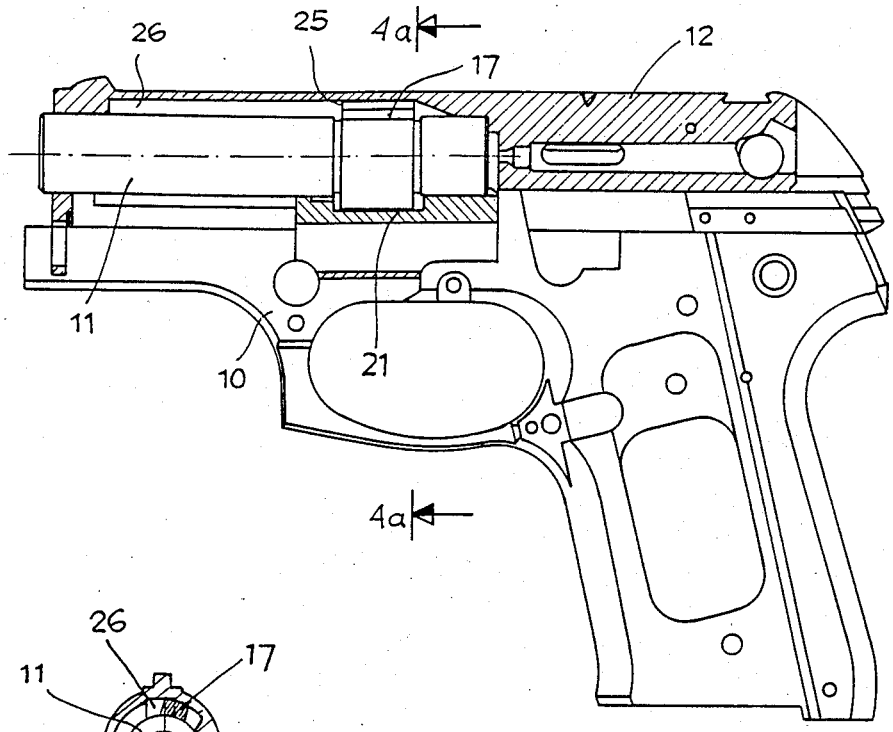
Figure 4A:
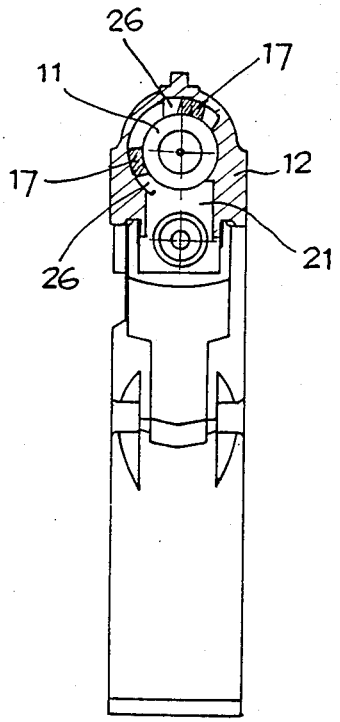
Figure 4B:
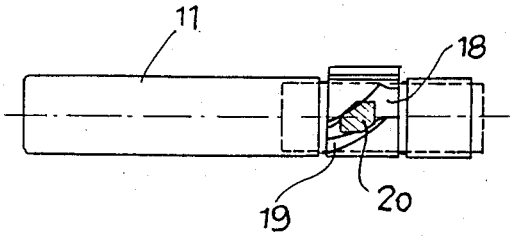

Then, through a second part of the recoil, barrel and bolt are still moving together, but the barrel is simultaneously rotating due to the interaction between tooth (20) and the helicoidal part (19) of the slot on the barrel. Hence, shoulder (17) on barrel (11) is angularly displaced towards the relating longitudinal groove (26) in bolt (12). This second intermediate position is shown on FIGS. 4, 4*a* and 4*b*.

Figure 5:
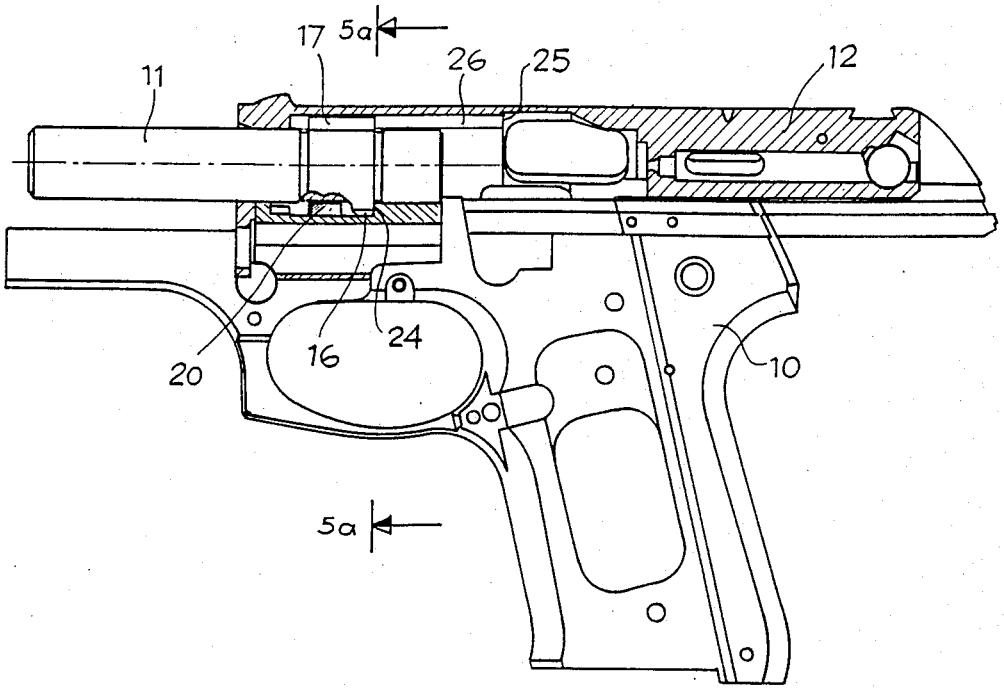
Figure 5A:
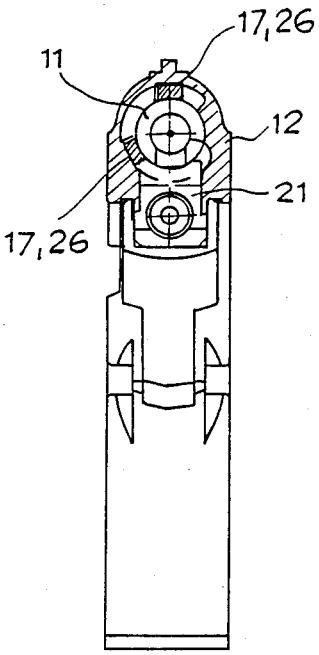
Figure 5B:
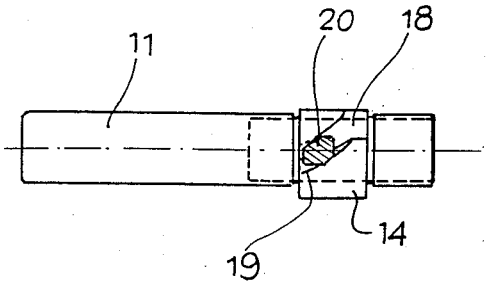

Now, when the barrel has moved back till its rear stop (16) is bearing against abutment (24) of the fixed block (21), it stops rotating and shoulder (17) falls into groove (26). Now the barrel is standing still and the bolt goes back to its open position represented in FIGS. 5, 5*a* and 5*b* allowing the ejection of the cartridge case and the advance of the hammer.

By the successive advance of the bolt the feed of another ammunition cartridge is obtained and an inverse sequence of the movements taking the bolt back to its initial closed position and the arm ready for use as shown in FIG. 2.

It is thus evident that the relative opening between barrel and bolt is delayed as it takes place during an intermediate part of the recoil stroke of the bolt and not at the beginning of said stroke in order to allow a full exploitation of the gas pressure in the barrel for the ejection of the shot and without any rearward gas outflow.

I claim:

1. A semiautomatic pistol construction, comprising: a stock including a fixed block with an outwardly extending tooth and outwardly extending abutments; a bolt positioned on said stock for axial movement along said stock between a forward position and a rearward position, a spring associated with said fixed block biasing said bolt into said forward position, said bolt having a barrel receiving opening and a stop plane surface extending into said opening, said stop plane surface having a bolt groove extending axially; a barrel positioned in said barrel opening of said bolt, said barrel being axially displaceable between said abutments, said barrel having a side defining a groove with an initial rectilinear groove portion extending substantially parallel to a central axis of said barrel followed by a helical groove portion, said barrel having another side defining a projecting shoulder, said tooth being engaged with said bolt, whereby said barrel rotates relative to said tooth as said tooth engages said helicoidal groove portion upon axial movement of said barrel, upon rotation of said barrel said shoulder coming into register with said bolt groove, thereby allowing said bolt to move rearwardly to its open position.

2. A semiautomatic pistol construction according to claim 1, wherein said rectilinear groove portion followed by said helicoidal groove portion are formed cut into a section extending radially outwardly of a surface of said barrel, said rectilinear groove portion being positioned rearwardly of said helicoidal groove portion, said section having axially spaced end stops engageable with corresponding surfaces of said outwardly extending abutments of said fixed block.

3. A semiautomatic pistol construction according to claim 2, wherein said bolt and barrel recoil together upon firing of the semiautomatic pistol for a first part of an opening stroke, and in a second part of the opening stroke said barrel stopping upon one of said end stops engaging one of said outwardly extending abutments while said bolt continues to move its open position, in said first part of the opening stroke said barrel and bolt being displaced without any relative motion and in said second part of said opening stroke said barrel rotating with respect to said bolt.

4. A semiautomatic pistol construction, comprising: a stock including a fixed block; a bolt positioned on said stock for axial movement along said stock between a forward position and rearward open position, a spring connected to said fixed block biasing said bolt into said forward position, said bolt having a barrel receiving opening; a barrel positioned in said barrel receiving opening of said bolt, said barrel being axially displaceable relative to said stock; and, bolt and barrel relative motion means, connected to said fixed block for allowing a first stroke part upon recoil in which said bolt and barrel are displaced with respect to said stock without any relative motion and a second stroke part in which said barrel rotates with respect to said bolt allowing said bolt to move independent rearwardly into its open position and for limiting the axial movement of said barrel.

* * * * *